US008129911B2

(12) United States Patent
Wilson

(10) Patent No.: US 8,129,911 B2
(45) Date of Patent: Mar. 6, 2012

(54) MAGNETRON

(75) Inventor: Robert Charles Wilson, Maldon Essex (GB)

(73) Assignee: E2V Technologies (UK) Limited, Chelmsford (GB)

( * ) Notice: Subject to any disclaimer, the term of this patent is extended or adjusted under 35 U.S.C. 154(b) by 143 days.

(21) Appl. No.: 12/407,477

(22) Filed: Mar. 19, 2009

(65) Prior Publication Data

US 2009/0236991 A1 Sep. 24, 2009

(30) Foreign Application Priority Data

Mar. 20, 2008 (GB) ..... 0805277.1

(51) Int. Cl.
*H05B 39/00* (2006.01)
*H05B 41/14* (2006.01)

(52) U.S. Cl. ..... 315/94; 315/105

(58) Field of Classification Search ..... 315/94, 315/97, 105, 500; 313/331, 337, 338, 339, 313/346 R
See application file for complete search history.

(56) References Cited

U.S. PATENT DOCUMENTS 2,815,467 A 12/1957 Gardner
3,859,558 A * 1/1975 Harada et al. ..... 315/39.51
4,686,413 A * 8/1987 Sato et al. ..... 313/346 R
5,216,327 A 6/1993 Myers et al.
5,861,716 A 1/1999 Ogura
6,132,565 A * 10/2000 Lin ..... 204/192.15
6,420,821 B1 * 7/2002 Kishiki et al. ..... 313/326

FOREIGN PATENT DOCUMENTS

CN 1992135 7/2007
EP 0627757 A2 12/1994
EP 1804554 A2 7/2007
GB 825566 A 12/1959

OTHER PUBLICATIONS

United Kingdom Search Report of GB0805277.1 Filed Jun. 30, 2008.

* cited by examiner

*Primary Examiner* — Douglas W Owens
*Assistant Examiner* — Minh D A
(74) *Attorney, Agent, or Firm* — Venable LLP; Robert Kinberg; Christopher Ma

(57) ABSTRACT

A magnetron has an anode 3 surrounding a tubular hollow cathode 4 which contains a heater 9. The cathode is supported by radial arms at each end. At one end of the cathode, the heater is supplied with one terminal of its D.C. supply by means of a radial arm 5, which also serves to support that end of the cathode. The arm has a portion 5*a* offset towards the cathode, and a cover of conducting material is interposed between the heater connection and the adjacent end wall 1 of the vacuum envelope. The cover may have a folded portion so that it can be carried by the arm.

6 Claims, 3 Drawing Sheets

MAGNETRON

CROSS-REFERENCE TO RELATED APPLICATIONS

This application claims the priority of Great Britain Application No. 0805277.1, filed Mar. 20, 2008, the contents of which is incorporated herein by reference.

BACKGROUND OF THE INVENTION

This invention relates to magnetrons.

A known magnetron will now be described with reference to FIGS. 1 and 2 of the drawings. FIG. 1 is a fragmentary sectional view of the magnetron, taken through the axis of the anode, and FIG. 2 is an enlarged view of the anode and cathode shown in FIG. 1. Referring to FIG. 1, the magnetron comprises a vacuum chamber having end walls 1 and 2, which are at right angles to the axis of the anode 3 and cathode 4 of the magnetron. There are resonant cavities (not shown) defined in the anode, or by vanes. A magnetic field is applied normal to the plane of the end walls 1,2, by an electromagnet or a permanent magnet (not shown).

The cathode 4 is tubular, and has a heater extending along its axis, and a D.C. supply to the heater, as well as a high negative voltage for the cathode, is supplied to the cathode by means of conducting supports 5,6, which extend into an upper region 7 of the magnetron, the interior of which is within the vacuum envelope. The conducting supports connect to terminals on a part of the exterior of the upper region that is not shown. Couplers (not shown) extend into a resonant cavity and withdraw power into an output section 8, which can be coupled to a waveguide.

Referring to FIG. 2, which shows the tubular cathode 4 in more detail, a small DC supply voltage for the heater 9 is provided between the supports 5,6, and a large pulsed negative DC voltage is applied to support 6 only. The heater 9 is connected to the end of the tubular cathode at its right-hand end (as seen in FIG. 2), and the support 6 directly connects to the cathode. At its left-hand end, the heater 9 is supported in the cathode by an insulating sleeve 10, and is connected to the support 5.

The cathode is supported on radial arms 5, 6 that enable the magnetic field to be applied directly by a separate electromagnet (not shown). The gap over which the magnetic field is applied is desirably minimized so the electromagnet is as small as possible and uses least power. The vacuum gap between the ends of the tubular cathode structure and the end walls 1,2 of the magnetron has to be sufficient to hold off the negative voltage, typically 50 KV, that is applied to the cathode relative to the anode and the magnetron body, including end walls, under normal working conditions. Experience has shown that the cathode to end wall gap is not adequate to prevent arcing under all conditions (particularly when driven with line-type modulators) and very occasionally this can have serious consequences when the arcing causes the end wall to puncture. It is believed that in addition to the applied pulse voltage across the cathode to side wall gap there are RF voltages picked up from where the cathode supports pass near the anode, particularly if there is a projection such as if the anode is provided with a strap 11. These picked-up voltages may be increased by resonances on the cathode supports or in the space between end plate and anode.

The heater connection 12 on the cathode is a sharp point, which further enhances the voltage stress in this area. The result is that the heater connection can form a seat for arcing, which can confine any arcing that occurs to the region of the wall 1 that is immediately adjacent, and thus increase the risk of perforation.

The Applicants contemplated counteracting this risk by the expedient of increasing the gap between side wall and cathode but this would mean the outline of the magnetron would need to change. However, there are thousands of equipments currently in use, which require the current profile for the magnetron, so such a modification would be disadvantageous. It is also undesirable to make anything more than the minimum change to the interior of the magnetron, as any change risks upsetting its operation.

SUMMARY OF THE INVENTION

The invention provides a magnetron comprising a cathode, an anode surrounding the cathode, the region between the anode and the cathode being within a vacuum chamber, a heater for the cathode having a D.C. supply connection at an end of the cathode, and a cover of conducting material interposed between the D.C. supply connection and the adjacent end of the vacuum chamber.

The cover to the heater terminal on the cathode hides any sharp point, thereby reducing voltage stress.

The cover plate could be made of any conductor that is vacuum tube compatible. Nickel or a nickel alloy would be suitable because of its availability, ease of machining and ease of joining.

BRIEF DESCRIPTION OF THE DRAWINGS

The invention will now be described in detail, by way of example, with reference to the accompanying drawings, in which.

Like parts have been given like reference numerals throughout all the drawings.

DETAILED DESCRIPTION

Figure 1:
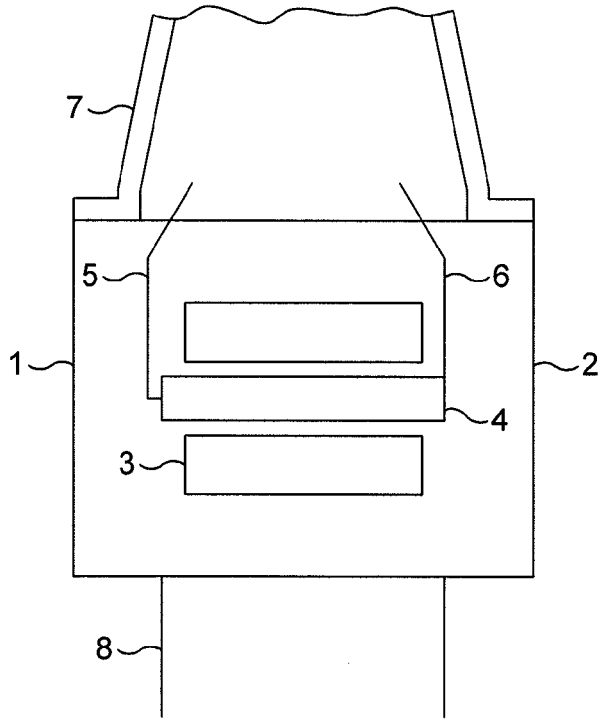
FIG. 1 PRIOR ART
FIG. 1 is a schematic sectional view of a known magnetron, partly cut away, taken through the axis of the cathode.
Figure 2:
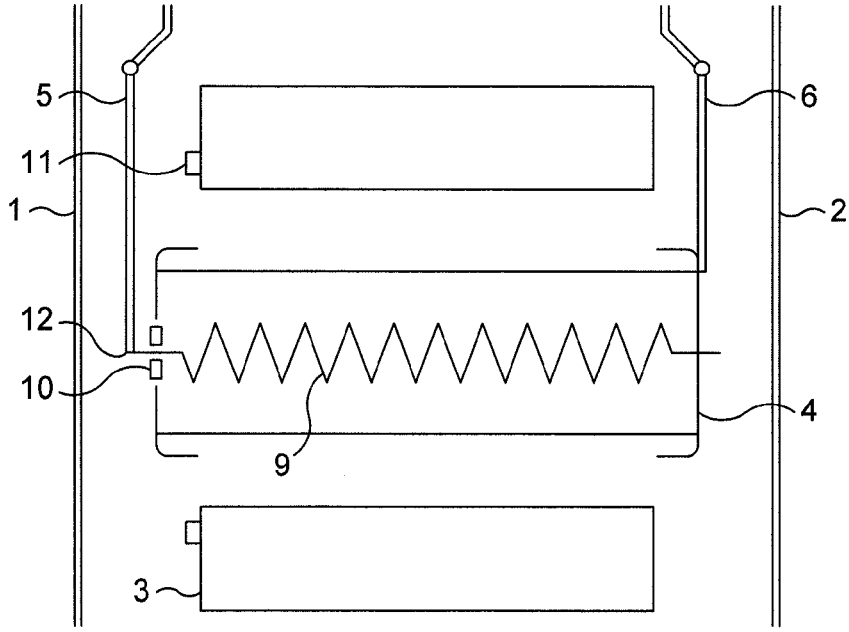
FIG. 2 PRIOR ART
FIG. 2 is a view of a part of the magnetron of FIG. 1 shown in greater detail.
Figure 3:
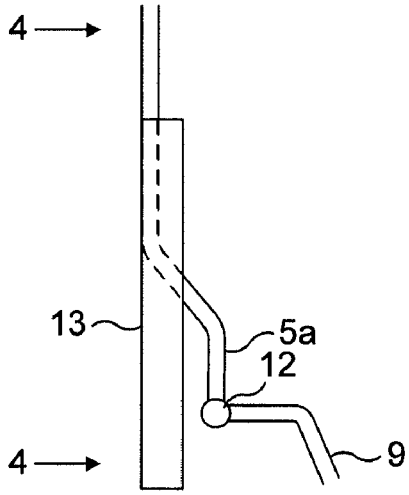
FIG. 3 shows a modification according to the invention to one part of the known magnetron of FIG. 2.
Figure 4:
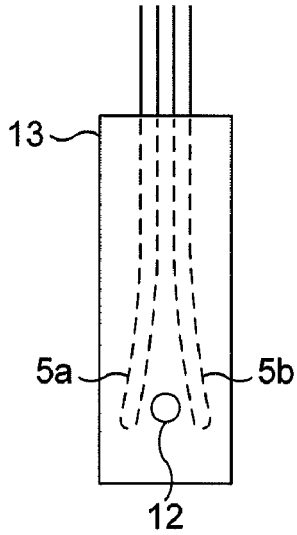
FIG. 4 is a view taken in the direction of the arrows 4-4 in FIG. 3.

The invention can best be appreciated by considering FIGS. 3 and 4 in conjunction with FIG. 2, which show a modification made in accordance with the invention to the known magnetron. By comparing FIG. 3 with FIG. 2, it will be seen that, the support arm 5 is provided with a region 5*a* which is offset towards the cathode, so that the connection point 12 between the heater and the support arm 5 is displaced nearer to the cathode than in the prior art magnetron. In addition and in accordance with the invention, a cover 13 of conducting material is interposed between the connection point 12 and the adjacent end wall 1 of the vacuum chamber. The cover is made of nickel, or a nickel alloy, but other conducting materials could be used if desired. The region of the arm 5 over which the cover extends is in fact formed by two closely spaced conductors, which diverge in the region of connection point 12 to make the connection to the end of the heater easier. The upper end of the cover is folded behind the support 5 in order to provide a secure anchorage for the cover to be welded or soldered to the arm, although the cover could if desired be mechanically mounted on the arm.

There will of course be the same voltage between the cover 13 and the adjacent wall 1 of the vacuum chamber (since the face of the plate follows the line of the original support 5), but the sharp point 12 is now electrostatically shielded, so that there is no tendency for such arcing as may occur to take place preferentially in the region of the wall 1 immediately adjacent the connection 12. Such arcing as occurs will be spread over the surface of the cover and over a corresponding area of the wall. Thus, the risk of perforation of the wall have been reduced or eliminated.

Figure 5:
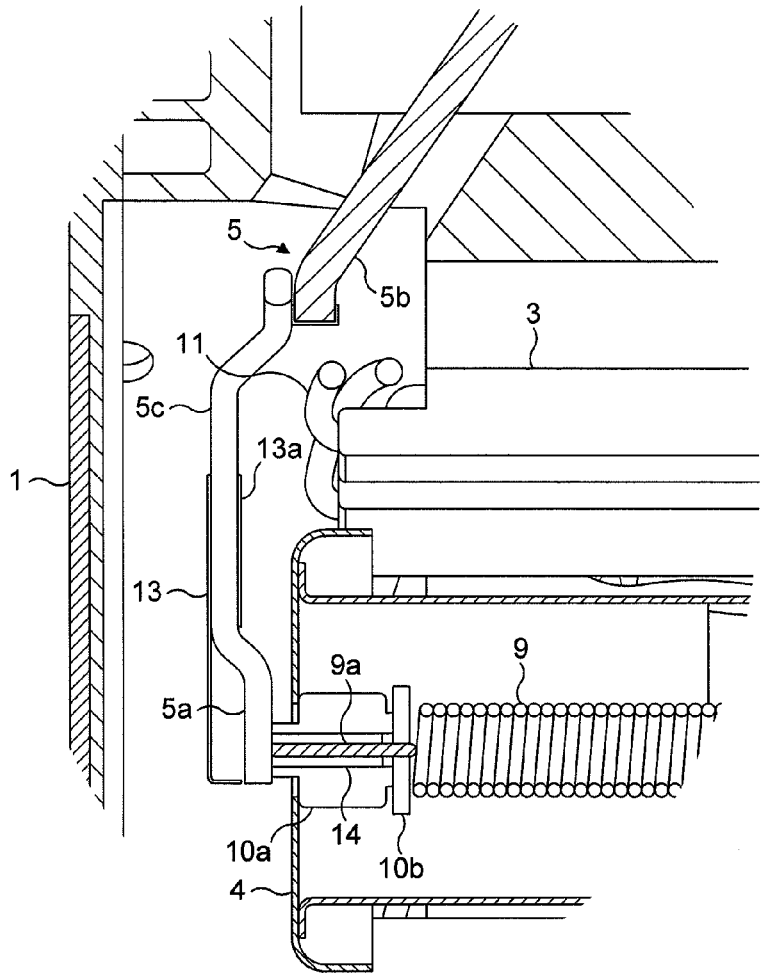
FIG. 5 is an axial section through a part of a magnetron according to the invention.
Figure 6:
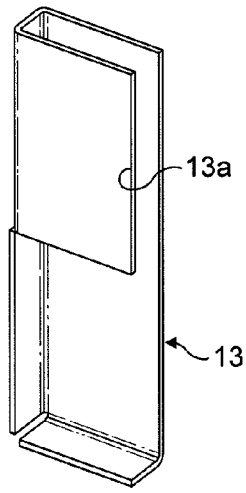
FIG. 6 is a perspective view of the cover used in the magnetron shown in FIG. 5.

FIGS. 5 and 6 show a practical embodiment of the invention. The heater 9 terminates in a lead 9*a* which is surrounded by a collar 14 that is insulated from the tubular cathode 4 by insulating sleeve 10*a* and insulating ring 10*b*. The support arm 5 is in two parts, 5*b* and 5*c*. The latter is formed by one length of conductor, which is bent into two closely spaced strands where the parts are joined. The strands are connected to opposite sides of the end of the heater lead. The cover is shown in FIG. 6, and it will be seen that the upper part of it is folded back on itself at 13*a*, the arm being sandwiched between the front and folded back section of the cover, and the cover is secured to the arm by welding or soldering.

The invention is especially applicable to high power magnetrons, that is, magnetrons with peak output powers exceeding 1 MW. A typical range of operating frequencies is from 1 GHz to 20 GHz, the design being especially suitable for S-band operation, that is, from 2 GHz to 4 GHz. Such magnetrons are suitable for use in linear accelerators.

The invention claimed is:

1. A magnetron comprising a cathode, an anode surrounding the cathode, the region between the anode and the cathode being within a vacuum chamber, a heater for the cathode having a D.C. supply connection at an end of the cathode, and a cover of conducting material interposed between the D.C. supply connection and the adjacent end wall of the vacuum chamber.

2. A magnetron as claimed in claim 1, wherein the cover has a folded region to be securely supported on the arm.

3. A magnetron as claimed in claim 1, wherein the D.C. supply connection is in a portion of the arm which is offset towards the cathode.

4. A magnetron as claimed in claim 1, wherein the cover is made of nickel or a nickel alloy.

5. A magnetron as claimed in claim 1, wherein the heater extends along a hollow interior of the cathode.

6. A magnetron as claimed in claim 5, including a lead which extends from the heater and which passes through an insulating sleeve in the end of the cathode.

* * * * *

UNITED STATES PATENT AND TRADEMARK OFFICE

CERTIFICATE OF CORRECTION

PATENT NO. : 8,129,911 B2
APPLICATION NO. : 12/407477
DATED : March 6, 2012
INVENTOR(S) : Wilson It is certified that error appears in the above-identified patent and that said Letters Patent is hereby corrected as shown below:

At column 4, claim 1 line 8-14 should read:

-- 1. A magnetron comprising a cathode, an anode surrounding the cathode, the region between the anode and the cathode being within a vacuum chamber, a heater for the cathode having a D.C. supply connection at an end of the cathode, and a cover of conducting material interposed between the D.C. supply connection and the adjacent end wall of the vacuum chamber, wherein the cover is supported on a support arm supplying D.C. to the heater, wherein the support arm is electrically coupled to the D.C. supply connection and electrically coupled to the cover, whereby the cover is electrically coupled to the D.C. supply connection, and wherein the cover is configured to spread any arcing which occurs over a surface of the cover and over a corresponding area of the adjacent end wall of the vacuum chamber. --

Signed and Sealed this
Twenty-ninth Day of May, 2012

David J. Kappos

David J. Kappos
*Director of the United States Patent and Trademark Office*